US006634150B1

(12) United States Patent
Oliver et al.

(10) Patent No.: US 6,634,150 B1
(45) **Date of Patent: *Oct. 21, 2003**

(54) FOUNDATION WITH LATERAL BRACE FOR MANUFACTURED HOME

(76) Inventors: James Oliver, P.O. Box 9, Hohenwald, TN (US) 38462; Evon L. Oliver, P.O. Box 9, Hohenwald, TN (US) 38462

( * ) Notice: Subject to any disclaimer, the term of this patent is extended or adjusted under 35 U.S.C. 154(b) by 2 days.

This patent is subject to a terminal disclaimer.

(21) Appl. No.: 09/778,217

(22) Filed: Feb. 8, 2001

Related U.S. Application Data

(63) Continuation-in-part of application No. 09/579,228, filed on May 30, 2000.

(51) Int. Cl.[7] ..... E04C 3/02; E02D 27/00; A47F 5/00

(52) U.S. Cl. ..... 52/292; 52/169.9; 52/695; 52/DIG. 11; 248/354.1; 248/354.5

(58) Field of Search ..... 52/126.6, 126.7, 52/169.9, 299, DIG. 11, 292, 695; 248/354.1, 354.5, 228.5

(56) References Cited

U.S. PATENT DOCUMENTS

| | | | | | |
|---|---|---|---|---|---|
| 4,261,149 | A | * | 4/1981 | Gustafson | 52/292 |
| 4,417,426 | A | * | 11/1983 | Meng | 52/126.7 |
| 4,429,851 | A | * | 2/1984 | DeJager | 248/354.5 |
| 4,546,581 | A | * | 10/1985 | Gustafson | 52/126.6 |
| 4,562,673 | A | * | 1/1986 | Barari | 280/763.1 |
| 4,582,167 | A | * | 4/1986 | Contreras | 182/182.1 |
| 4,866,797 | A | * | 9/1989 | Vollan | 52/126.6 |
| 4,937,989 | A | * | 7/1990 | Miyares et al. | 182/182.1 |
| 5,359,821 | A | * | 11/1994 | Merriman | 52/126.6 |
| 5,509,237 | A | * | 4/1996 | Coulter | 248/357 |
| 5,524,854 | A | * | 6/1996 | McSwain et al. | 248/235 |
| 5,873,679 | A | * | 2/1999 | Cusimano | 405/229 |
| 6,058,663 | A | * | 5/2000 | MacKarvich | 52/167.3 |
| 6,119,412 | A | * | 9/2000 | Jackson | 248/188.1 |
| 6,318,032 | B2 | * | 11/2001 | MacKarvich | 52/167.3 |
| 6,343,449 | B1 | * | 2/2002 | MacKarvich | 24/545 |
| 6,381,907 | B1 | * | 5/2002 | MacKarvich | 52/105 |
| 6,505,447 | B1 | * | 1/2003 | Oliver et al. | 52/292 |
| 2002/0095880 | A1 | * | 7/2002 | MacKarvich | 52/169.12 |

* cited by examiner

*Primary Examiner*—Carl D. Friedman
*Assistant Examiner*—Kevin McDermott
(74) *Attorney, Agent, or Firm*—Calif Tervo

(57) ABSTRACT

A foundation for a manufactured home generally comprises a ground pan and a lateral brace assembly. Manufactured home has first and second elongate support beams with first beam supported by upright pier and second beam having a lateral flange having a free end. Ground pan, for disposition beneath pier includes a cleat for insertion in ground for preventing horizontal movement of pan. Lateral brace assembly includes an elongate, rigid, and adjustable-length lateral brace, having a bottom end pivotably supported by ground pan and a top end pivotably attached to a beam connector attached to second beam. Beam connector includes: a bracket including a traversing portion, traversing flange and a slot adapted for receiving flange; and a vertical retaining means for bearing on beam opposite slot.

7 Claims, 1 Drawing Sheet

FOUNDATION WITH LATERAL BRACE FOR MANUFACTURED HOME

CROSS-REFERENCE TO RELATED APPLICATIONS

This application is a continuation-in-part of co-pending application Ser. No. 09/579,228, filed May 30, 2000.

FIELD OF THE INVENTION

This invention relates to a foundation for a manufactured home, mobile home or trailer coach, and more specifically to a foundation that provides vertical support and lateral stability.

BACKGROUND OF THE INVENTION

Manufactured homes, mobile homes or trailer coaches include long longitudinal support beams underneath. Typically, when the home or coach is installed, a plurality of vertical piers or jacks are placed under the beams to support them. Most piers or jacks require placement on a rigid ground pan so as not to sink into the ground from the loading.

Conventional piers do not provide resistance to lateral forces that may be exerted on the coach, such as by strong winds or earthquakes. Consequently, additional bracing systems must be attached to resist lateral forces.

Since all of these support and bracing devices have to be installed in the field, it is desirable that they be simple to install, preferably by a single person, not require complex tools and not require any alterations to the existing beams, such as drilling, that could deleteriously affect the strength of the beams.

SUMMARY OF THE INVENTION

This invention is a foundation for a manufactured home having first and second elongate, horizontal, parallel, support beams; the first beam being supported by an upright support pier and the second beam having a lateral flange.

The foundation generally comprises a ground pan and a lateral brace assembly. The ground pan, disposed on the ground beneath the pier, includes cleats for insertion in the ground for preventing horizontal movement of the pan. The lateral brace assembly generally includes an elongate lateral brace of adjustable length having an upper end pivotably attached by a beam connector to the second beam and a lower end pivotably attached to the ground pan.

The beam connector includes a bracket including a traversing portion traversing the outer surface of the flange of the second beam and a slot adapted for receiving a beam flange such that upward and downward forces are transferred between the lateral brace and the flange, and compressive lateral forces are transferred from the lateral brace to the flange. A vertical retainer, such as a bolt, is attached to the bracket for bearing on the opposite side of the beam from the slot, such that tensile lateral forces are transferred from the beam to bracket.

Other features and many attendant advantages of the invention will become more apparent upon a reading of the following detailed description together with the drawings wherein like reference numerals refer to like parts throughout.

DETAILED DESCRIPTION OF THE INVENTION

Figure 2:
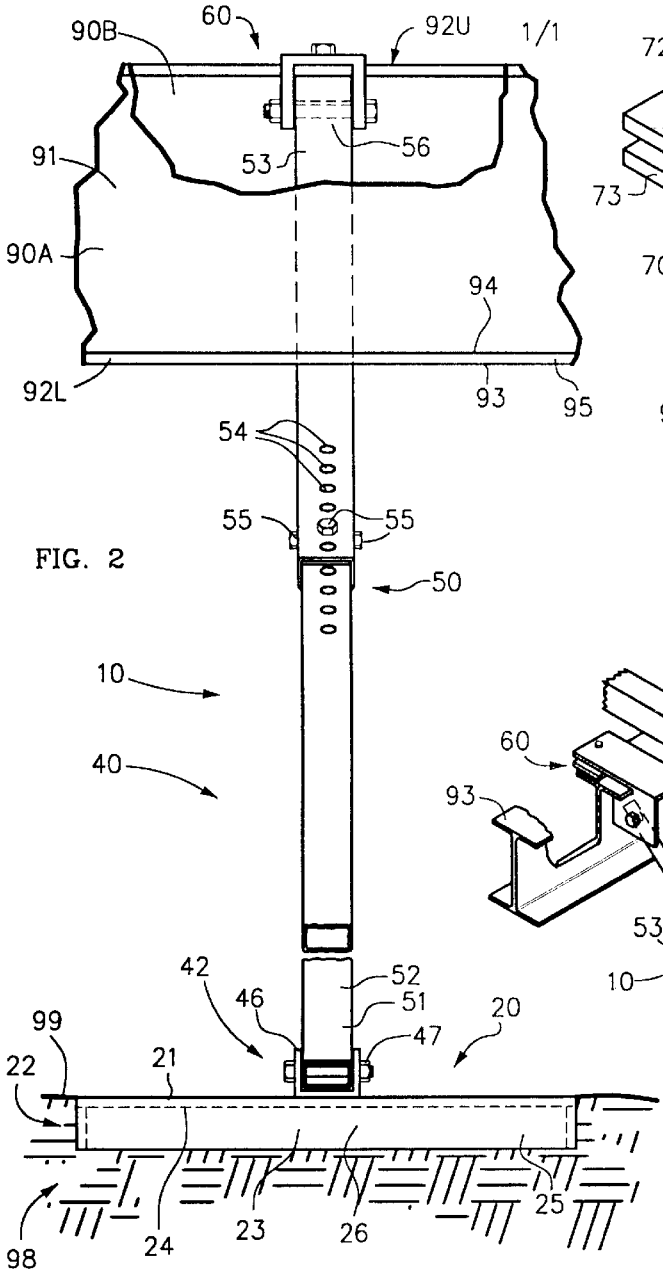
FIG. 2 is a front elevation view, partially cut away, of the foundation of FIG. 1 with the pier omitted.
Figure 1:
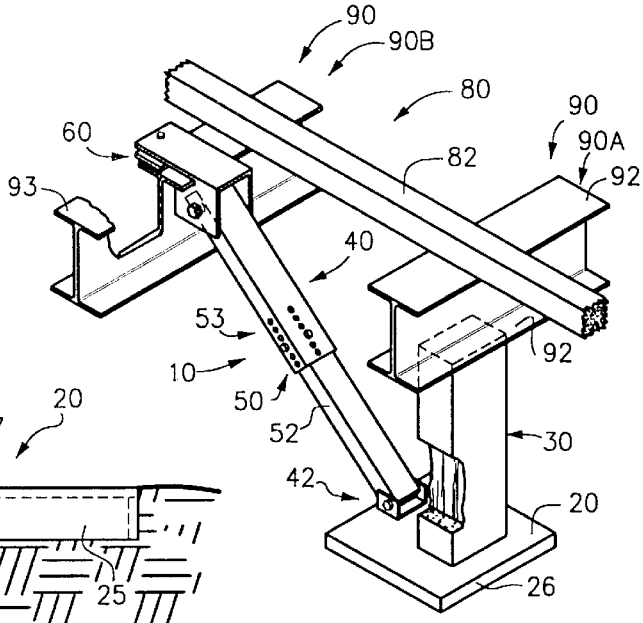
FIG. 1 is a perspective view of a preferred embodiment of the foundation of the invention attached to support beams of a manufactured home.

With reference now to the drawings, FIG. 1 is a perspective view of a preferred embodiment of the foundation 10 of the invention attached to support beams 90 of a manufactured home 80, and FIG. 2 is a front elevation view, partially cut away, of the foundation 10 of FIG. 1.

A manufactured home 80 includes a plurality of parallel lateral floor joists 82 supported by a pair of support beams 90 parallel to the home's longitudinal axis. Support beams 90 includes first beam 90A and second beam 90B. Beams 90, shown, are typical I-beams made such as of steel and are elongate, horizontal and parallel. Each beam 90 includes a vertical web 91, a lateral flange 92, such as upper and lower lateral flanges 92U, 92L respectively. Each flange 92 has a outer surface 93, an inner surface 94 and a free end 95, or, with the I-beam 90 shown, two free ends 95. Beams 90 are typically twelve inches in height and are spaced apart ninety six inches between webs 91. Although I-beams are shown and described, it will be seen that the invention is applicable to other beams, such as C-beams, with only slight modifications.

Foundation 10 generally comprises a ground pan 20, a pier 30 and a lateral brace assembly 40.

Ground pan 20 is disposed under first beam 90A. Ground pan 20 provides support for pier 30 and lateral brace assembly 40. Ground pan 20 includes a plate 21 having a downward facing lower surface 24 for bearing on grade 99 of ground 98. Plate 21 is made of strong stiff material, such as of steel or galvanized iron of twelve or greater gauge. Typical dimensions are twenty or twenty four inches square. Ground pan 20 includes anchoring means 22 attached to plate 21, such as ground insertion means 23, inserted in the ground 98, for preventing horizontal movement of pan 20. Ground insertion means 23 may be any suitable means, such as spikes, but, preferably, has a large side surface for resisting lateral forces. In the preferred embodiment shown, ground insertion means 23 includes downward blades or cleats 25 about the periphery of plate 21. Cleats 25 may be part of plate 21 bent over or may be stiff angle members attached to plate 21. Cleats 25 present a wall, such as wall 26 transverse to brace 50, for bearing against soil 98 for resisting lateral forces.

Pier 30 is positioned on ground pan 20 for vertically supporting first beam 90A and transferring the weight of manufactured home 80 and pier 30 to pan 20 whereby cleats 25 are driven into ground 98 and provide firm resistance to horizontal movement of pan 20. Pier 30 includes a top end placed under beam 90A and a bottom end placed on pan 20. Pier 30 may be made of concrete masonry, steel, or other appropriate material. Pier 30 may or may not be adjustable in height.

Lateral brace assembly 40 provides resistance to lateral loads, such as produced by wind or earthquake. Lateral brace assembly 40 generally includes pan connector 42, beam connector 60, and lateral brace 50 therebetween. Lateral brace 50 is an elongate, rigid member having a bottom end 51 pivotably supported by pan connector 42 and a top end 56 pivotably attached to beam connector 60.

Brace 50 is adjustable in length and includes a first member, such as first elongate box tube 52 and a second member, such as second elongate box tube 53, selectively, longitudinally, slidably engaged with the first member for adjusting the length of brace 50. First tube 52 may be one and one-quarter inch square or box tube and second tube 53 may be one and one-half inch box tube that telescopically slides over the first tube 52. Locking means between first and second tubes 52, 53, fixes their relative position and therefore fixes the length of brace 50. In the preferred embodiment, the locking means includes a plurality of bores 54 in outer or second tube 53. One or more fastener, such as self-tapping screws 55 are placed in bores 54 and attached to inner or first tube 52.

Pan connector 42 pivotably attaches brace 50 to pan 20. U-bracket 46 is attached by any suitable means, such as by welding or a bolt, to pan 20. Means, such as a pivot or journal bolt 47, attached to U-bracket 46, pivotably connects bracket 46 with bottom end 51 of brace 50.

Figure 3:
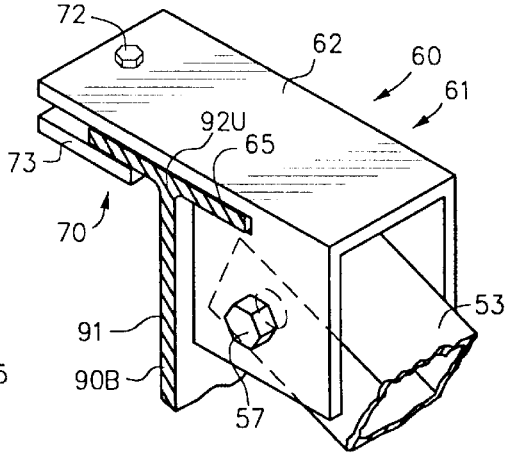
FIG. 3 is an enlarged perspective view of the beam connector attached to the second beam.
Figure 4:
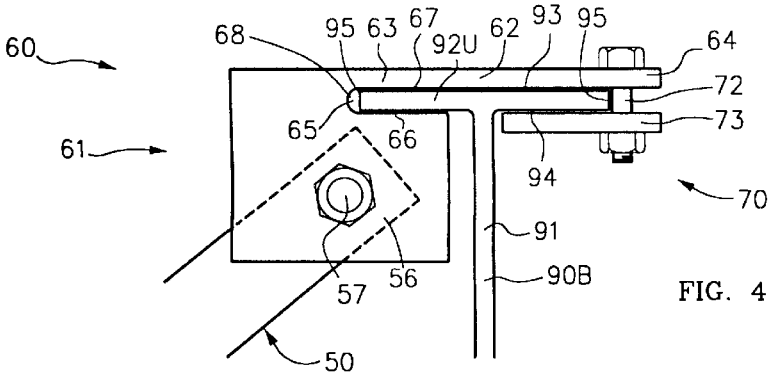
FIG. 4 is a side elevation view of the beam connector of FIG. 3.

Further including FIGS. 3 and 4, FIG. 3 is an enlarged perspective view of beam connector 60 attached to second beam 90B and FIG. 4 is a side elevation view of beam connector 60 of FIG. 3.

Beam connector 60 attaches to flange 92, such as on upper lateral flange 92U, of second beam 90B. Beam connector 62 could instead be attached lower flange 92L, but upper flange 92U is attached to floor joist 82 and, therefore, is better supported and stronger.

Beam connector 62 generally includes a bracket 61 and retaining means 70. Bracket 61 includes a traversing portion 62 traversing outer surface 93 of flange 92 of second beam 90B. Traversing portion 62 includes a first end 63 and a second end 64. Bracket 61 includes a slot 65 including a first side 66 for bearing against inner surface 94 of flange 92, a second side 67, which may be part of traversing portion 62, for bearing on outer surface 93 of flange 92, and an end 68 for bearing on free end 95 of flange 92. Slot 65 is adapted for receiving flange 92 such that upward and downward forces are transferred between lateral brace 50 and flange 92 and compressive lateral forces are transferred from lateral brace 50 to flange 92.

Retaining means 70 includes a vertical member, such as bolt 72, that passes downward through a bore in second end 64 of traversing portion 62 and projects downward for contacting the side of beam 90B opposite slot 65 such that tensile lateral forces are transferred from beam 90B to beam connector 60 and hence to lateral brace 50. Because slot 65 transfers the other forces, it can be appreciated that retaining means 70 need transfer only tensile forces. Plate 73, connected to bolt 72, helps retain second end 64 of traversing portion 62 to second beam 90B.

Top end 56 of lateral brace 50 is pivotably attached to beam connector 60, such as by pivot bolt 57 in bracket 61 such that all forces are transferred.

Having described the invention, it can be seen that it provides a very convenient foundation for supporting a manufactured home while simultaneously providing resistance to lateral forces on the home. Foundation 10 is easy to set up in the field with a minimum of tools and personnel.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. A foundation for a manufactured home having first and second elongate, horizontal, and parallel support beams, the second beam having an upper lateral flange; said foundation comprising:

a ground support for disposition on the ground beneath the first beam for vertically supporting the first beam and for interaction with the ground for resisting lateral movement;

a pier for positioning on said ground support for vertically supporting the first beam and transferring the weight of the manufactured home and pier to said ground support; and a lateral brace assembly including:

a beam connector adapted for clamping attachment to the upper lateral flange of the second beam; and an elongate and rigid lateral brace including:

a bottom end pivotably supported by said ground support; and a top end pivotably attached to said beam connector.

2. The foundation of claim 1 wherein the upper flange has A foundation for a manufactured home having first and second elongate, horizontal, and parallel support beams, the second beam having an upper lateral flange having free ends, said foundation comprising:

a ground support for disposition on the ground beneath the first beam for vertically supporting the first beam and for interaction with the ground for resisting lateral movement;

a pier for positioning on said ground support for vertically supporting the first beam and transferring the weight of the manufactured home and pier to said ground support; and a lateral brace assembly including:

a beam connector adapted for clamping attachment to the upper lateral flange of the second beam and wherein; said beam connector is adapted to bear against the free ends of the upper flange of the second beam; and an elongate and rigid lateral brace including:

a bottom end pivotably supported by said ground support; and a top end pivotably attached to said beam connector.

3. The foundation of claim 1 wherein: said lateral brace includes: A foundation for a manufactured home having first and second elongate horizontal, and parallel support beams, the second beam having an upper lateral flange, said foundation comprising:

a ground support for disposition on the ground beneath the first beam for vertically supporting the first beam and for interaction with the ground for resisting lateral movement;

a pier for positioning on said ground support for vertically supporting the first beam and transferring the weight of the manufactured home and pier to said ground support, and a lateral brace assembly including:

a beam connector adapted for clamping attachment to the upper lateral flange of the second beam; and an elongate and rigid lateral brace including:

a bottom end pivotably supported by said ground support;

a top end pivotably attached to said beam connector; and length adjustment means for adjusting the length of said lateral brace.

4. A lateral brace assembly for a manufactured home having first and second elongate, horizontal, and parallel support beams, the first beam supported by an upright support pier, the pier supported by a ground support disposed on the ground beneath the pier for vertically supporting the first beam and for interaction with the ground for resisting lateral movement; the second beam having an upper lateral flange having free ends, an outer surface, and an inner surface, said lateral brace assembly comprising:

an elongate and rigid lateral brace including:

a bottom end pivotably supported by the ground support; and a top end; and a beam connector for attachment to the second beam, said beam connector comprising:

a bracket including:

means for pivotably attaching said top end of said lateral brace to said bracket;

a traversing portion traversing the outer surface of the flange of the second beam including:

a first end including:

a slot including:

a first side;

a second side, and an end; said slot adapted for sliding over a free end of the flange such that said first side bears against the inner surface of the flange, said second side bears against the outer surface of the flange, and said end bears against the free end of the flange and upward and downward forces are transferred between said lateral brace and the flange;

a second end; and retaining means connected to said second end of said traversing portion for retaining said second end to the other free end of the lateral flange including:

bearing means for bearing against the other free end of the lateral flange.

5. The lateral brace assembly of claim 4 wherein said lateral brace includes:

length adjustment means for adjusting the length of said lateral brace.

6. A method for laterally bracing a manufactured home having first and second elongate, horizontal, parallel support disposed on the ground beneath the pier for vertically supporting the first beam and for interaction with the ground for resisting lateral movement, the second beam having an upper lateral flange having free ends, an outer surface, and an inner surface; with a lateral brace assembly including an elongate and rigid lateral brace including a bottom end, and a top end and a beam connector comprising a bracket including a traversing portion for traversing the outer surface of the flange of the second beam including a first end including a slot including a first side, a second side, and an end; the slot adapted for sliding over a free end of the flange such the first side bears against the inner surface of the flange, the second side bears against the outer surface of the flange, and the end bears against the free end of the flange and upward and downward forces are transferred between the lateral brace and the flange, a second end, and retaining means for retaining the second end to the other free end of the lateral flange including bearing means for bearing against the other free end of the lateral flange, said method comprising the steps of:

pivotably attaching the bottom end of the lateral brace to the ground support;

pivotably attaching the top end of the lateral brace to the bracket;

sliding the slot of the bracket over a free end of the flange such that the first side bears against the inner surface of the flange, the second side bears against the outer surface of the flange, and the end bearings against a free end of the flange; and retaining the second end of the traversing portion to the other free end of the flange with the retaining means such that the bearing means bears against the other free end of the flange.

7. The method of claim 6 wherein the lateral brace includes length adjustment means for adjusting the length of said lateral brace and further including the step of adjusting the length of the lateral brace using the adjustment means.

* * * * *

UNITED STATES PATENT AND TRADEMARK OFFICE

CERTIFICATE OF CORRECTION

PATENT NO. : 6,634,150 B1 
DATED : October 21, 2003
INVENTOR(S) : James Oliver and Evon L. Oliver It is certified that error appears in the above-identified patent and that said Letters Patent is hereby corrected as shown below:

Column 4,
Line 23, delete "The foundation of claim 1 wherein the upper flange has."
Line 40, delete "wherein; said beam connector is."
Line 47-48, delete "The foundation of claim 1 wherein said lateral brace includes:."

Signed and Sealed this

Sixteenth Day of March, 2004

JON W. DUDAS
*Acting Director of the United States Patent and Trademark Office*